US009607603B1

(12) United States Patent
Ebenezer

(10) Patent No.: US 9,607,603 B1
(45) Date of Patent: Mar. 28, 2017

(54) ADAPTIVE BLOCK MATRIX USING PRE-WHITENING FOR ADAPTIVE BEAM FORMING

(71) Applicant: Cirrus Logic International Semiconductor Ltd., Edinburgh (GB)

(72) Inventor: Samuel P. Ebenezer, Tempe, AZ (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 14/871,688

(22) Filed: Sep. 30, 2015

(51) Int. Cl.
*G10K 11/16* (2006.01)
*G10K 11/175* (2006.01)

(52) U.S. Cl.
CPC ..... *G10K 11/175* (2013.01)

(58) Field of Classification Search
CPC ..... G10K 11/175
USPC ..... 381/71.11
See application file for complete search history.

(56) References Cited

U.S. PATENT DOCUMENTS

| | | | | |
|---|---|---|---|---|
| 2004/0071284 | A1 | 4/2004 | Abutalebi et al. | |
| 2007/0273585 | A1 | 11/2007 | Sarroukh et al. | |
| 2009/0121934 | A1* | 5/2009 | Sugiyama | G01S 3/04 342/372 |
| 2011/0051956 | A1 | 3/2011 | Jeong et al. | |

FOREIGN PATENT DOCUMENTS

| | | | |
|---|---|---|---|
| EP | 2237270 | A1 | 10/2010 |
| WO | 2009/034524 | | 3/2009 |

OTHER PUBLICATIONS

Nordebo et al., "Adaptive Beamforming: Spatial Filter Designed Blocking Matrix", IEEE Journal of Oceanic Engineering, vol. 19, No. 4, Oct. 1994, pp. 583-589.
Griffiths, Lloyd J. and Jim, Charles W., "An Alternative Approach to Linearly Constrained Adaptive Beamforming", IEEE Transactions on Antennas and Propagation, Jan. 1982, vol. AP-30, No. 1, pp. 27-34.
Laakso et al., "Splitting the Unit—Tools for fractional delay filter design", IEEE Signal Processing Magazine, Jan. 1996, pp. 30-60.
Arablouei et al., "Analysis of the Gradient-Descent Total Least-Squares Adaptive Filtering Algorithm", IEEE Transactions on Signal Processing, Mar. 1, 2014, vol. 62, No. 5, pp. 1256-1264.
(Continued)

*Primary Examiner* — Paul S Kim
*Assistant Examiner* — Katherine Faley
(74) *Attorney, Agent, or Firm* — Norton Rose Fulbright US LLP

(57) ABSTRACT

An adaptive filter of an adaptive blocking matrix in an adaptive beam former or null former may be modified to track and maintain noise correlation between an input and a reference noise signal to the adaptive noise canceller module. That is, a noise correlation factor may be determined, and that noise correlation factor may be used in an inter-sensor signal model applied when generating the blocking matrix output signal. The output signal may then be further processed within the adaptive beamformer to generate a less-noisy representation of the speech signal received at the microphones. The inter-sensor signal model may be estimated using a gradient decent total least squares (GrTLS) algorithm. Further, spatial pre-whitening may be applied in the adaptive blocking matrix to further improve noise reduction.

32 Claims, 7 Drawing Sheets

(56) References Cited

OTHER PUBLICATIONS

Golub, Gene H. and Van Loan, Charles F., "An Analysis of the Total Least Squares Problem", Society for Industrial and Applied Mathematics, Dec. 1980, vol. 17, No. 6, pp. 883-893.

Lin Wang et al., "Noise power spectral density estimation using MaxNSR blocking matrix," IEEE/ACM Transactions on Audio, Speech, and Language Processing, IEEE, USA, vol. 23, No. 9, Sep. 1, 2815 (2815-89-81), pp. 1493-1588.

* cited by examiner

ADAPTIVE BLOCK MATRIX USING PRE-WHITENING FOR ADAPTIVE BEAM FORMING

FIELD OF THE DISCLOSURE

The instant disclosure relates to digital signal processing. More specifically, portions of this disclosure relate to digital signal processing for microphones.

BACKGROUND

Telephones and other communications devices are used all around the globe in a variety of conditions, not just quiet office environments. Voice communications can happen in diverse and harsh acoustic conditions, such as automobiles, airports, restaurants, etc. Specifically, the background acoustic noise can vary from stationary noises, such as road noise and engine noise, to non-stationary noises, such as babble and speeding vehicle noise. Mobile communication devices need to reduce these unwanted background acoustic noises in order to improve the quality of voice communication. If the origin of these unwanted background noises and the desired speech are spatially separated, then the device can extract the clean speech from a noisy microphone signal using beamforming.

One manner of processing environmental sounds to reduce background noise is to place more than one microphone on a mobile communications device. Spatial separation algorithms use these microphones to obtain the spatial information that is necessary to extract the clean speech by removing noise sources that are spatially diverse from the speech source. Such algorithms improve the signal-to-noise ratio (SNR) of the noisy signal by exploiting the spatial diversity that exists between the microphones. One such spatial separation algorithm is adaptive beamforming, which adapts to changing noise conditions based on the received data. Adaptive beamformers may achieve higher noise cancellation or interference suppression compared to fixed beamformers. One such adaptive beamformer is a Generalized Sidelobe Canceller (GSC). The fixed beamformer of a GSC forms a microphone beam towards a desired direction, such that only sounds in that direction are captured, and the blocking matrix of the GSC forms a null towards the desired look direction. One example of a GSC is shown in FIG. 1.

FIG. 1 is an example of an adaptive beamformer according to the prior art. An adaptive beamformer 100 includes microphones 102 and 104, for generating signals x1[*n*] and x2[*n*], respectively. The signals x1[*n*] and x2[*n*] are provided to a fixed beamformer 110 and to a blocking matrix 120. The fixed beamformer 110 produces a signal, a[n], which is a noise reduced version of the desired signal contained within the microphone signals x1[*n*] and x2[*n*]. The blocking matrix 120, through operation of an adaptive filter 122, generates a b[n] signal, which is a noise signal. The relationship between the desired signal components that are present in both of the microphones 102 and 104, and thus signals x1[*n*] and x2[*n*], is modeled by a linear time-varying system, and this linear model h[n] is estimated using the adaptive filter 122. The reverberation/diffraction effects and the frequency response of the microphone channel can all be subsumed in the impulse response h[n]. Thus, by estimating the parameters of the linear model, the desired signal (e.g., speech) in one of the microphones 102 and 104 and the filtered desired signal from the other microphone are closely matched in magnitude and phase thereby, greatly reducing the desired signal leakage in the signal b[n]. The signal b[n] is processed in adaptive noise canceller 130 to generate signal w[n], which is a signal containing all correlated noise in the signal a[n]. The signal w[n] is subtracted from the signal a[n] in adaptive noise canceller 130 to generate signal y[n], which is a noise reduced version of the desired signal picked up by microphones 102 and 104.

One problem with the conventional beamformer is that the adaptive blocking matrix 120 may unintentionally remove some noise from the signal b[n] causing noise in the signals b[n] and a[n] to become uncorrelated. This uncorrelated noise cannot be removed in the canceller 130. Thus, some of the undesired noise may remain present in the signal y[n] generated in the processing block 130 from the signal b[n]. The noise correlation is lost in the adaptive filter 122. Thus, it would be desirable to modify processing in the adaptive filter 122 of the conventional adaptive beamformer 100 to operate to reduce destruction of noise cancellation within the adaptive filter 122.

Shortcomings mentioned here are only representative and are included simply to highlight that a need exists for improved electrical components, particularly for signal processing employed in consumer-level devices, such as mobile phones. Embodiments described herein address certain shortcomings but not necessarily each and every one described here or known in the art.

SUMMARY

One solution may include modifying the adaptive filter to track and maintain noise correlation between the microphone signals. That is, a noise correlation factor may be determined and that noise correlation factor may be used to derive the correct inter-sensor signal model using an adaptive filter in order to generate the signal b[n]. That signal b[n] may then be further processed within the adaptive beamformer to generate a less-noisy representation of the speech signal received at the microphones. In one embodiment, spatial pre-whitening may be applied in the adaptive blocking matrix to further improve noise reduction. The adaptive blocking matrix and other components and methods described above may be implemented in a mobile device to process signals received from near and/or far microphones of the mobile device.

In one embodiment, a gradient descent total least squares (GrTLS) algorithm may be applied to estimate the inter-signal model in the presence of a plurality of noisy sources. The GrTLS algorithm may incorporate a cross-correlation noise factor and/or pre-whitening filters for generating the noise-reduced version of the signal provided by the plurality of noisy speech sources. In an embodiment of a cellular telephone, the plurality of noisy sources may include a near microphone and a far microphone. The near microphone may be a microphone located near the end of the phone closest to location where the user's mouth is positioned during a telephone call. The far microphone may be located anywhere else on the cellular telephone that is a location farther from the user's mouth.

According to one embodiment, a method may include receiving, by a processor coupled to a plurality of sensors, at least a first noisy input signal and a second noisy input signal, each of the first noisy signal and the second noisy signal from the plurality of sensors; determining, by the processor, at least one estimated noise correlation statistic between the first noisy input signal and the second noisy input signal; and/or executing, by the processor, a learning algorithm that estimates an inter-sensor signal model between the first noisy input signal and the second noisy input signal based, at least in part, on the at least one estimated noise correlation statistic such that a noise correlation is maintained between an input to an adaptive noise canceller module and an output of the blocking matrix.

In certain embodiments, the step of executing the learning algorithm may include executing an adaptive filter that calculates at least one filter coefficient based, at least in part, on the estimated noise correlation statistic; the step of executing the adaptive filter may include solving a total least squares (TLS) cost function comprising the estimated noise correlation statistic; the step of executing the adaptive filter may include solving a total least squares (TLS) cost function to derive a gradient descent total least squares (GrTLS) learning method that uses the estimated noise correlation statistic; the step of executing the adaptive filter may include solving a least squares (LS) cost function that includes the estimated noise correlation statistic; the step of executing the adaptive filter may include solving a least squares (LS) cost function to derive a least mean squares (LMS) learning method that uses the estimated noise correlation statistic; the step of filtering may include applying a spatial pre-whitening approximation to at least one of the first noisy signal and the second noisy signal; and/or the step of applying the spatial pre-whitening approximation may be performed without a direct matrix inversion and a without matrix square root computation.

In certain embodiments, the method may also include filtering, by the processor, at least one of the first noisy input signal and the second noisy input signal before the step of determining the at least one estimated noise correlation statistic, such as filtering with a pre-whitening filter; applying the estimated inter-sensor signal model to at least one of the first noisy input signal and the second noisy input signal; combining the first noisy input signal and the second noisy input signal after applying the estimated inter-sensor signal model to at least one of the first noisy input signal and the second noisy input signal; and/or applying an inverse temporal pre-whitening filter on the combined first noisy input signal and the second noisy input signal.

According to another embodiment, an apparatus may include a first input node configured to receive a first noisy input signal; a second input node configured to receive a second noisy input signal; and/or a processor coupled to the first input node and coupled to the second input node. The processor may be configured to perform steps including receiving at least a first noisy input signal and a second noisy input signal from the plurality of sensors; determining at least one estimated noise correlation statistic between the first noisy input signal and the second noisy input signal; and/or executing a learning algorithm that estimates an inter-sensor signal model between the first noisy input signal and the second noisy input signal based, at least in part, on the at least one estimated noise correlation statistic such that a noise correlation is maintained between an input to an adaptive noise canceller module and an output of the blocking matrix.

In some embodiments, the processor may be further configured to execute a step of filtering, by the processor, noise, such as with a temporal pre-whitening filter, to at least one of the first noisy input signal and the second noisy input signal before the step of determining the at least one estimated noise correlation statistic; applying the estimated inter-sensor signal model to at least one of the first noisy input signal and the second noisy input signal; combining the first noisy input signal and the second noisy input signal after applying the estimated inter-sensor signal model to at least one of the first noisy input signal and the second noisy input signal; and/or applying an inverse temporal pre-whitening filter on the combined first noisy input signal and the second noisy input signal.

In certain embodiments, the step of executing the learning algorithm may include executing an adaptive filter that calculates at least one filter coefficient based, at least in part, on the estimated noise correlation statistic; the step of executing the adaptive filter may include solving a total least squares (TLS) cost function comprising the estimated noise correlation statistic; the step of executing the adaptive filter may include solving a total least squares (TLS) cost function to derive a gradient descent total least squares (GrTLS) learning method that uses the estimated noise correlation statistic; the step of executing the adaptive filter may include solving a least squares (LS) cost function that includes the estimated noise correlation statistic; the step of executing the adaptive filter may include solving a least squares (LS) cost function to derive a least mean squares (LMS) learning method that uses the estimated noise correlation statistic; the step of filtering may include applying a spatial pre-whitening approximation to at least one of the first noisy signal and the second noisy signal; the step of applying the spatial pre-whitening approximation may be performed without a direct matrix inversion and without a matrix square root computation; the first input node may be configured to couple to a near microphone; the second input node may be configured to couple to a far microphone; and/or the processor may be a digital signal processor (DSP).

According to another embodiment, an apparatus may include a first input node configured to receive a first noisy input signal from a first sensor; a second input node configured to receive a second noisy input signal from a second sensor; a fixed beamformer module coupled to the first input node and coupled to the second input node; a blocking matrix module coupled to the first input node and coupled to the second input node, wherein the blocking matrix module executes a learning algorithm that estimates an inter-sensor signal model between the first noisy input signal and the second noisy input signal based, at least in part, on at least one estimated noise correlation statistic such that a noise correlation is maintained between an input to an adaptive noise canceller module and an output of the blocking matrix; and/or an adaptive noise canceller coupled to the fixed beamformer module and coupled to the blocking matrix module, wherein the adaptive noise cancelling filter is configured to output an output signal representative of a desired audio signal received at the first sensor and the second sensor.

In certain embodiments, the blocking matrix module is configured to execute steps including applying a spatial pre-whitening approximation to the first noisy signal; applying another or the same spatial pre-whitening approximation to the second noisy signal; applying the estimated inter-sensor signal model to at least one of the first noisy input signal and the second noisy input signal; combining the first noisy input signal and the second noisy input signal after applying the estimated inter-sensor signal model; and/or applying an inverse pre-whitening filter on the combined first noisy input signal and the second noisy input signal.

According to a further embodiment, a method may include receiving, by a processor coupled to a plurality of sensors, at least a first noisy input signal and a second noisy input signal from the plurality of sensors; and/or executing, by the processor, a gradient descent based total least squares (GrTLS) algorithm that estimates an inter-sensor signal model between the first noisy input signal and the second noisy input signal.

In certain embodiments, the method may also include applying a pre-whitening filter to at least one of the first noisy input signal and the second noisy input signal; the step of applying a pre-whitening filter may include applying a spatial and a temporal pre-whitening filter; and/or the GrTLS algorithm may include at least one estimated noise correlation statistic such that a noise correlation is maintained between an input to an adaptive noise canceller module and an output of the blocking matrix.

According to another embodiment, an apparatus may include a first input node for receiving a first noisy input signal; a second input node for receiving a second noisy input signal; and/or a processor coupled to the first input node, coupled to the second input node, and configured to perform the step of executing a gradient descent based total least squares (GrTLS) or normalized least means square (NLMS) with a pre-whitening update algorithm that estimates an inter-sensor signal model between the signals a[n] and b[n].

In certain embodiments, the processor may be further configured to perform a step comprising applying a pre-whitening filter to at least one of the first noisy input signal and the second noisy input signal; the step of applying a pre-whitening filter may include applying a spatial and a temporal pre-whitening filter; and/or the GrTLS or NLMS with a pre-whitening update algorithm may include at least one estimated noise correlation statistic such that a noise correlation is maintained between an input to an adaptive noise canceller module and an output of the blocking matrix.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 2:
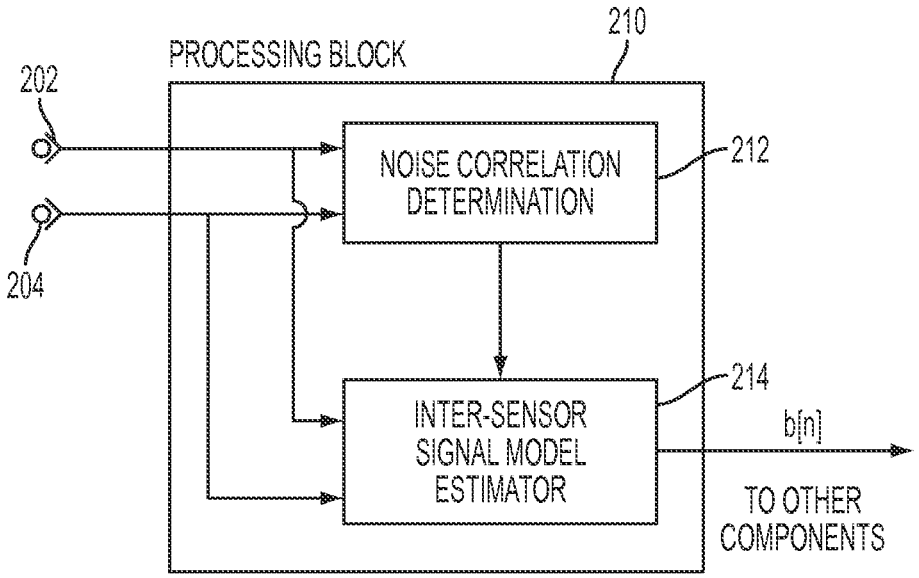
FIG. 2 is an example block diagram illustrating a processing block that determines a noise correlation factor for an adaptive blocking matrix according to one embodiment of the disclosure.

When noise remains correlated between microphones, a better speech signal is obtained from processing the microphone inputs. A processing block for an adaptive filter that processes signals by maintaining a noise correlation factor is shown in FIG. 2. FIG. 2 is an example block diagram illustrating a processing block that determines a noise correlation factor for an adaptive blocking matrix according to one embodiment of the disclosure. A processing block 210 receives microphone data from input nodes 202 and 204, which may be coupled to the microphones. The microphone data is provided to a noise correlation determination block 212 and an inter-sensor signal model estimator 214. The inter-sensor signal model estimator 214 also receives a noise correlation factor, such as $r_{q2q1}$ described below, calculated by the noise correlation determination block 212. The inter-sensor signal model estimator 214 may implement a learning algorithm, such as a normalized least means square (NLMS) algorithm or a gradient total least squares (GrTLS) algorithm, to generate a noise signal b[n] that is provided to further processing blocks or other components. The other components may use the b[n] signal to generate, for example, a speech signal with reduced noise than that received at either of the microphones individually.

Figure 3:
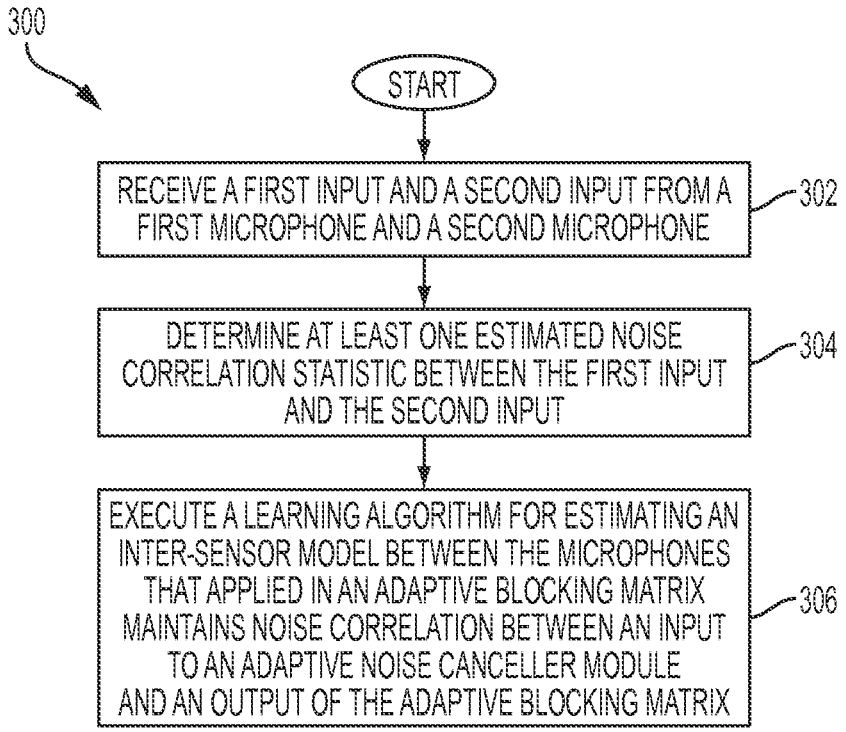
FIG. 3 is an example flow chart for processing microphone signals with a learning algorithm according to one embodiment of the disclosure.

An example of a method of processing the microphone signals to improve noise correlation in an adaptive blocking matrix is shown in FIG. 3. FIG. 3 is an example flow chart for processing microphone signals with a learning algorithm according to one embodiment of the disclosure. A method 300 may begin at block 302 with receiving a first input and a second input, such as from a first microphone and a second microphone, respectively, of a communication device. At block 304, a processing block, such as in a digital signal processor (DSP), may determine at least one estimated noise correlation statistics between the first input and the second input. Then, at block 306, a learning algorithm may be executed, such as by the DSP, to estimate an inter-sensor model between the first and second microphones. The estimated inter-sensor model may be based on the determined noise correlation statistic of block 304 and applied in an adaptive blocking matrix to maintain noise correlation between the first input and the second input as the first input and the second input are being processed. For example, by maintaining noise correlation between the a[n] and b[n] signals, or more generally maintaining correlation between an input to an adaptive noise canceler block and an output of the adaptive blocking matrix.

Figure 4:
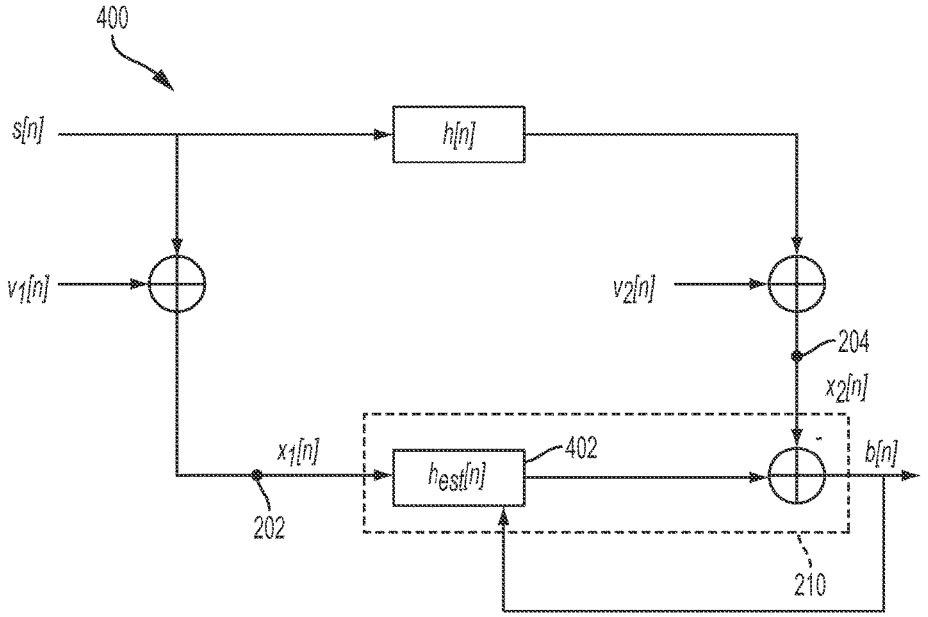
FIG. 4 is an example model of signal processing for adaptive blocking matrix processing according to one embodiment of the disclosure.

The processing of the microphone signals by an adaptive blocking matrix in accordance with such a learning algorithm is illustrated by the processing models shown in FIG. 4, FIG. 5, FIG. 6, and FIG. 7. FIG. 4 is an example model of signal processing for adaptive blocking matrix processing according to one embodiment of the disclosure. In an adaptive beamformer, the main aim of the blocking matrix is to estimate the system h[n] with $h_{est}[n]$ such that the desired directional speech signal s[n] can be cancelled through a subtraction process. A speech signal s[n] may be detected by two microphones, in which each microphone experiences different noises, of which the noises are illustrated as v1[*n*] and v2[*n*]. Input nodes 202 and 204 of FIG. 4 indicate the signals as received from the first microphone and the second microphone, x1[*n*] and x2[*n*], respectively. The system h[n] is represented as added to the second microphone signal as part of the received signal. Although h[n] is shown being added to the signal, when a digital signal processor receives the signal x2[*n*] from a microphone, the h[n] signal is generally an inseparable component of the signal x2[*n*] and combined with the other noise v2[*n*] and with the speech signal s[n]. A blocking matrix then generates a model 402 that estimates $h_{est}[n]$ to model h[n]. Thus, when $h_{est}[n]$ is added to the signal from the first microphone x1[*n*], and that signal combined with the x2[*n*] signal in processing block 210, the output signal b[n] has cancelled out the desired speech signal. The additive noises v1[*n*] and v2[*n*] are correlated with each other, and the degree of correlation depends on the microphone spacing.

The unknown system h[n] can be estimated in $h_{est}[n]$ using an adaptive filter. The adaptive filter coefficients can be updated using a classical normalized least squares (NLMS) as shown in the following equation:

$$h_{k+1} = h_k + \frac{\mu}{x_k^T x_k + \delta} e[k] x_k,$$

where $$x_k = [x_1[k] x_1[k-1] \ldots x_1[k-L+1]]^T$$

represents past and present samples of signal $x_1$ [n], and L is a number of finite impulse response (FIR) filter coefficients that can be adjusted, and μ is the learning rate that can be adjusted based on a desired adaptation rate. The depth of convergence of the NLMS-based filter coefficients estimate may be limited by the correlation properties of the noise present in signals $x_1[n]$ (reference signal) and $x_2[n]$ (input signal).

The coefficients of adaptive filter 402 of system 400 may alternatively be calculated based on a total least squares (TLS) approach, such as when the observed (both reference and input) signals are corrupted by uncorrelated white noise signals. In one embodiment of a TLS approach, a gradient-descent based TLS solution (GrTLS) is given by the following equation:

$$h_{k+1} = h_k + \frac{2\mu e[k]}{(1 + h_k^T h_k)} \left[ x_k + \frac{e[k] h_k}{(1 + h_k^T h_k)} \right].$$

The type of the learning algorithm implemented by a digital signal processor, such as either NLMS or GrTLS, for estimating the filter coefficients may be selected by a user or a control algorithm executing on a processor. The depth of converge improvement of the TLS solution over the LS solution may depend on the signal-to-noise ratio (SNR) and the maximum amplitude of the impulse response.

A TLS learning algorithm may be derived based on the assumption that the additive noises v1[*n*] and v2[*n*] are both temporally and spatially uncorrelated. However, the noises may be correlated due to the spatial correlation that exists between the microphone signals and also the fact that acoustic background noises are not spectrally flat (i.e. temporally correlated). This correlated noise can result in insufficient depth of convergence of the learning algorithms.

Figure 5:
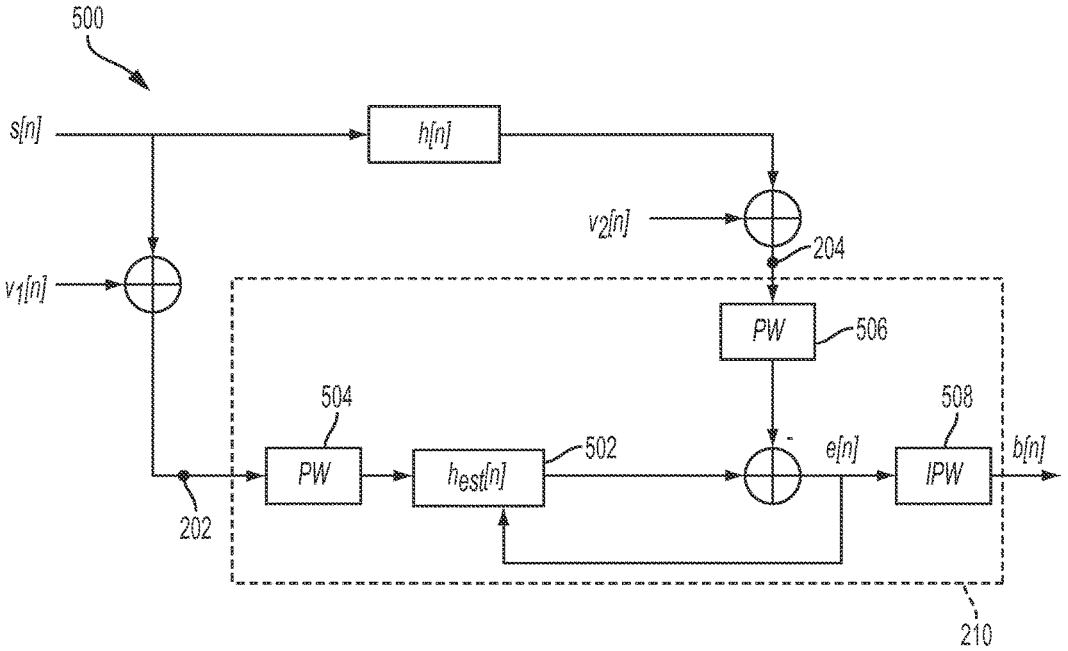
FIG. 5 is an example model of signal processing for adaptive blocking matrix processing with a pre-whitening filter according to one embodiment of the disclosure.

The effects of temporal correlation may be reduced by applying a fixed pre-whitening filter on the signals x1[*n*] and x2[*n*] received from the microphones. FIG. 5 is an example model of signal processing for adaptive blocking matrix processing with a pre-whitening filter according to one embodiment of the disclosure. Pre-whitening (PW) blocks 504 and 506 may be added to processing block 210. The PW blocks 504 and 506 may apply a pre-whitening filter to the microphone signals x1[*n*] and x2[*n*], respectively, to obtain signals y1[*n*] and y2[*n*]. The noises in the corresponding pre-whitened signals are represented as q1[*n*] and q2[*n*], respectively. The pre-whitening (PW) filter may be implemented using a first order finite impulse response (FIR) filter. In one embodiment, the PW blocks 504 and 506 may be adaptively modified to account for a varying noise spectrum in the signals x1[*n*] and x2[*n*]. In another embodiment, the PW blocks 504 and 506 may be fixed pre-whitening filters.

The PW blocks 504 and 506 may apply spatial and/or temporal pre-whitening. The selection of using either the spatial pre-whitened based update equations or other update equations may be controlled by a user or by an algorithm executing on a controller. In one embodiment, the temporal and the spatial pre-whitening process may be implemented as a single step process using the complete knowledge of the square root inverse of the correlation matrix. In another embodiment, the pre-whitening process may be split into two steps in which the temporal pre-whitening is performed first followed by the spatial pre-whitening process. The spatial pre-whitening process may be performed by approximating the square root inverse of the correlation matrix. In another embodiment, the spatial pre-whitening using the approximated square root inverse of the correlation matrix is embedded in the coefficient update step of the inter-signal model estimation process.

After applying an adaptive filter 502, which may be similar to the adaptive filter 402 of FIG. 4, and combining the signals to form signal e[n], the filtering effect of the pre-whitening process may be removed in an inverse pre-whitening (IPW) block 508, such as by applying an IIR filter on the signal e[n]. In one embodiment, the numerator and denominator coefficients of the PW filter is given by ($a_0$=1, $a_1$=0, $b_0$=0.9, $b_1$=−0.7) and of IPW filter is given by ($a_0$=0.9, $a_1$=−0.7, $b_0$=1, $b_1$=0), where $a_i$'s and $b_i$'s are the denominator and numerator coefficients of an IIR filter. The output of the IPW block 508 is the b[n] signal.

The effects of the spatial correlation can be addressed by decorrelating the noise using a decorrelating matrix that can be obtained from the spatial correlation matrix. Instead of explicitly decorrelating the signals, the cross-correlation of the noise can be included in the cost function of the minimization problem and a gradient descent algorithm that is a function of the estimated cross-correlation function can be derived for any learning algorithm selected for the adaptive filter 502.

For example, for a TLS learning algorithm, coefficients for the adaptive filter 502 may be computed from the following equation:

$$h_{k+1} = h_k + \frac{2\mu e[k]}{(1+h_k^T h_k)}\left[y_1 + \frac{e[k]h_k}{(1+h_k^T h_k)}\right] - \frac{\mu}{\sigma_q^{1.5}(1+h_k^T h_k)}\left[y_1 r_{q_2q_1}^T (y_1 - y_2[k]h_k) + y_2[k]e[k]r_{q_2q_1} + \frac{2e[k]h_k r_{q_2q_1}^T (y_1 - y_2[k]h_k)}{(1+h_k^T h_k)}\right].$$

As another example, for a LS learning algorithm, coefficients for the adaptive filter 502 may be computed from the following equation:

$$h_{k+1} = h_k + 2\mu e[k]y_1 - \frac{\mu}{\sigma_q^{1.5}}\left[y_1 r_{q_2q_1}^T (y_1 - y_2[k]h_k) + y_2[k]e[k]r_{q_2q_1}\right],$$

where $\sigma_q$ is the standard deviation of the background noise which can be computed by taking the square root of the average noise power, and where $r_{q_2q_1}$ is the cross-correlation between the temporally whitened microphone signals. The smoothed standard deviations may then be obtained from the following equation:

$$\sigma_q[l] = \alpha\sigma_q[l-1] + (1-\alpha)\sqrt{E_q[l]},$$

where Eq[l] is the averaged noise power and $\alpha$ is the smoothing parameter.

In general, the background noises arrive from far field and therefore the noise power at both microphones may be assumed to have the same power. Thus, the noise power from either one of the microphones can be used to calculate Eq[l]. The smoothed noise cross-correlation estimate $r_{q_2q_1}$ is obtained as:

$$r_{q_2q_1}[m,l] = \beta r_{q_2q_1}[m,l-1] + (1-\beta)\hat{r}_{q_2q_1}[m,l],$$

where $$\hat{r}_{q_2q_1}[m,l] = \frac{1}{N}\sum_{n=0}^{N-1} q_2[n,l]q_1[n-m,l];$$

$$m = D-M, \ldots, D+M-1, D+M,$$

where m is the cross-correlation delay lag in samples, N is the number of samples used for estimating the cross-correlation and it is set to 256 samples, l is the super-frame time index at which the noise buffers of size N samples are created, D is the causal delay introduced at the input x2[*n*], and β is an adjustable smoothing constant. Referring back to FIG. 2, the $r_{q_2q_1}$ factor described above may be computed by the noise correlation determination block 212.

The noise cross-correlation value may be insignificant as lag increases. In order to reduce the computational complexity, the cross-correlation corresponding to only a select number of lags may be computed. The maximum cross-correlation lag M may thus be adjustable by a user or determined by an algorithm. A larger value of M may be used in applications in which there are fewer number of noise sources, such as a directional, interfering, competing talker or if the microphones are spaced closely to each other.

The estimation of cross-correlation during the presence of desired speech may corrupt the noise correlation estimate, thereby affecting the desired speech cancellation performance. Therefore, the buffering of data samples for cross-correlation computation and the estimation of the smoothed cross-correlation may be enabled at only particular times and may be disabled, for example, when there is a high confidence in detecting the absence of desired speech.

Figure 6:
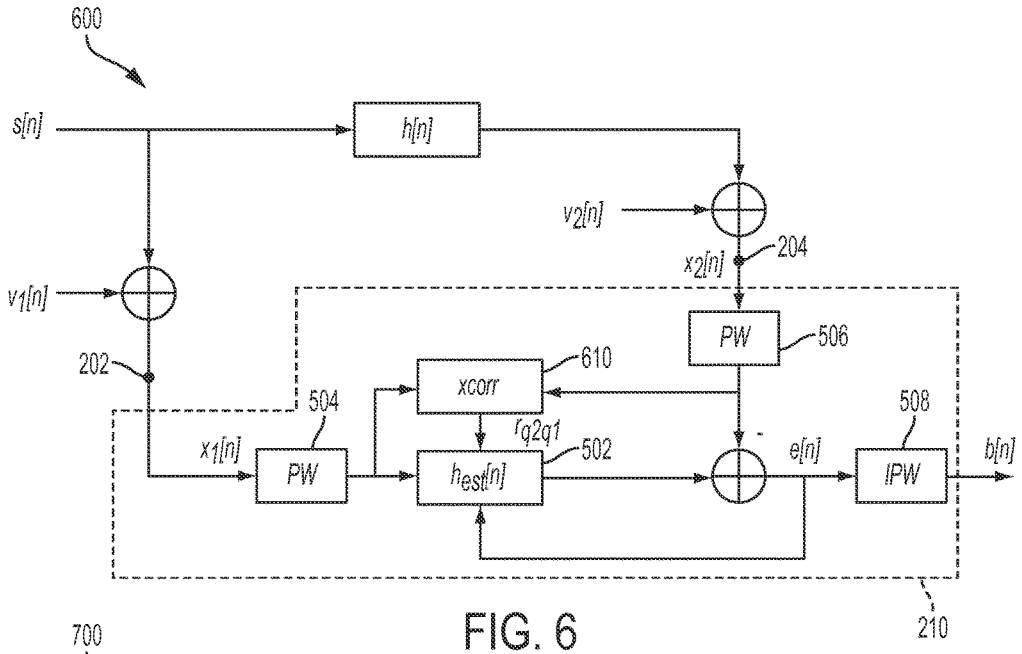
FIG. 6 is an example model of signal processing for adaptive blocking matrix processing with a pre-whitening filter prior to noise correlation determination according to one embodiment of the disclosure.

FIG. 6 is an example model of signal processing for adaptive blocking matrix processing with a pre-whitening filter prior to noise correlation determination according to one embodiment of the disclosure. System 600 of FIG. 6 is similar to system 500 of FIG. 5, but includes noise correlation determination block 610. Correlation block 610 may receive, as input, the pre-whitened microphone signals from blocks 504 and 506. Correlation block 610 may output, to the adaptive filter 502, a noise correlation parameter, such as $r_{q_2q_1}$.

Figure 7:
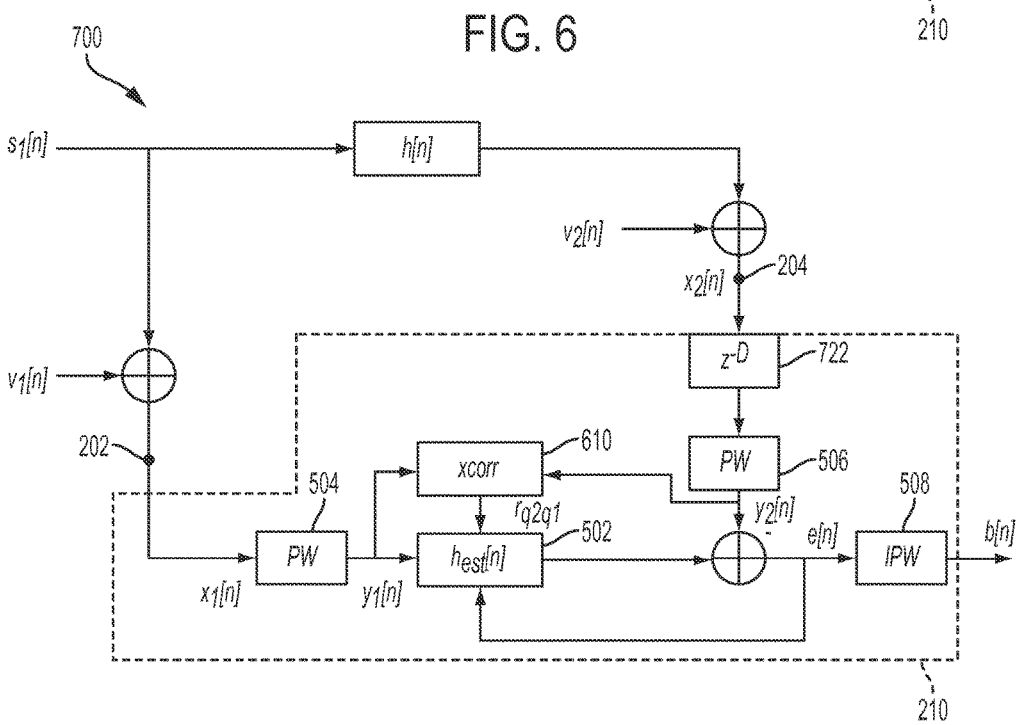
FIG. 7 is an example model of signal processing for adaptive blocking matrix processing with a pre-whitening filter and delay according to one embodiment of the disclosure.

FIG. 7 is an example model of signal processing for adaptive blocking matrix processing with a pre-whitening filter and delay according to one embodiment of the disclosure. System 700 of FIG. 7 is similar to system 600 of FIG. 6, but includes delay block 722. Depending on the direction of arrival of the desired signal and the selected reference signal, the impulse response of the system h[n] can result in an acausal system. This acausal system may be implemented by introducing a delay ($z^{-D}$) block 722 at an input of the adaptive filter 502, such that the estimated impulse response is a time shifted version of the true system. The delay at block 722 introduced at the input may be adjusted by a user or may be determined by an algorithm executing on a controller.

Figure 8:
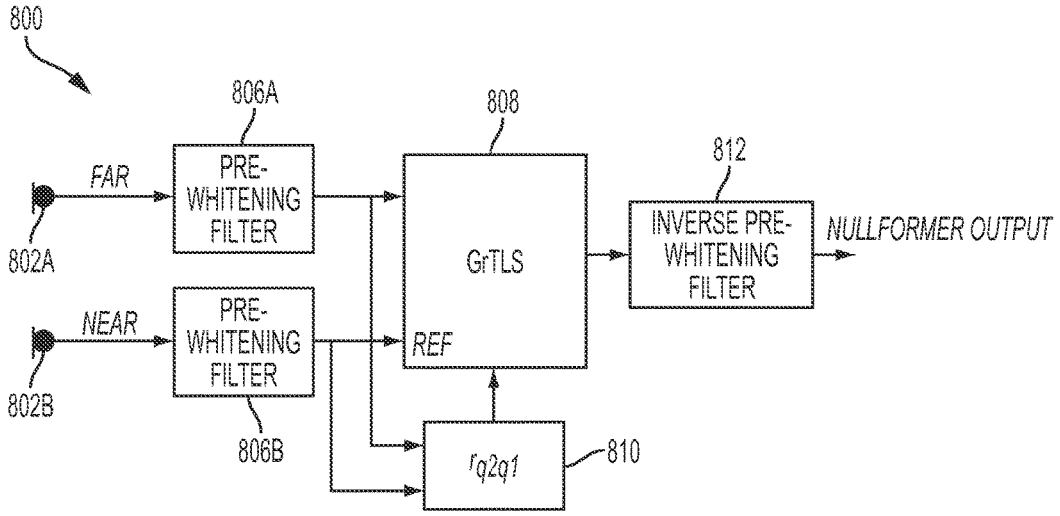
FIG. 8 is an example block diagram of a system for executing a gradient descent total least squares (TLS) learning algorithm according to one embodiment of the disclosure.

A system for implementing one embodiment of a signal processing block is shown in FIG. 8. FIG. 8 is an example block diagram of a system for executing a gradient decent total least squares (TLS) learning algorithm according to one embodiment of the disclosure. A system 800 includes noisy signal sources 802A and 802B, such as digital micro-electromechanical systems (MEMS) microphones. The noisy signals may be passed through pre-temporal whitening filters 806A and 806B, respectively. Although two filters are shown, in one embodiment a pre-whitening filter may be applied to only one of the signal sources 802A and 802B. The pre-whitened signals are then provided to a correlation determination module 810 and a gradient descent TLS module 808. The modules 808 and 810 may be executed on the same processor, such as a digital signal processor (DSP). The correlation determination module 810 may determine the parameter $r_{q_2q_1}$, such as described above, which is provided to the GrTLS module 808. The GrTLS module 808 then generates a signal representative of the speech signal received at both of the input sources 802A and 8082B. That signal is then passed through an inverse pre-whitening filter 812 to generate the signal received at the sources 802A and 802B. Further, the filters 806A, 806B, and 812 may also be implemented on the same processor, or digital signal processor (DSP), as the GrTLS block 808.

Figure 9:
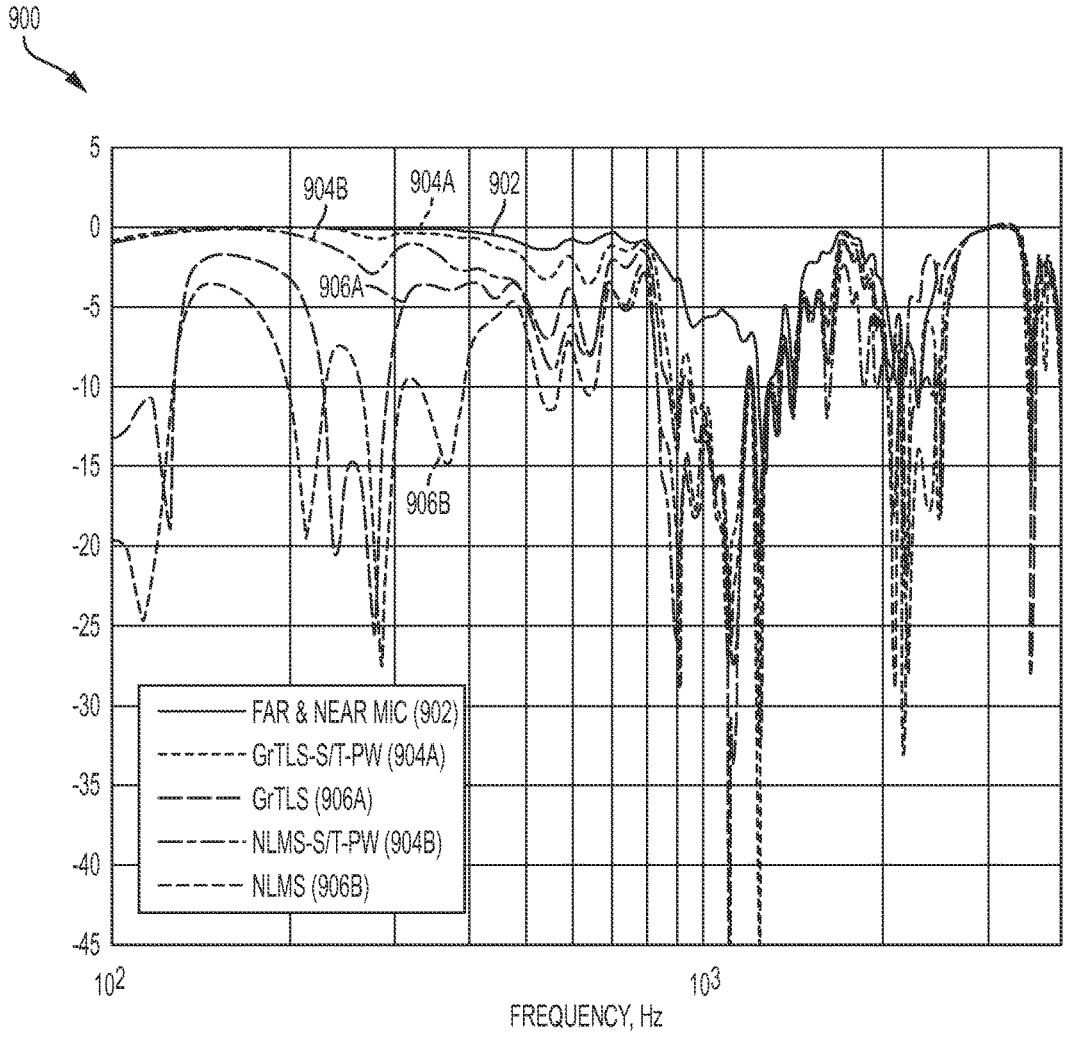
FIG. 9 are example graphs illustrating noise correlation values for certain example inputs applied to certain embodiments of the present disclosure.

The results of applying the above-described example systems can be illustrated by applying sample noisy signals to the systems and determining the noise reduction at the output of the systems. FIG. 9 are example graphs illustrating noise correlation values for certain example inputs applied to certain embodiments of the present disclosure. Graph 900 is a graph of the magnitude square coherence between the reference signal to the adaptive noise canceller (the b[n]

signal) and its input (the a[n] signal). A nearly ideal case is shown as line 902. Noise correlation graphs for an NLMS learning algorithm are shown as lines 906A and 906B. Noise correlation graphs for a GrTLS learning algorithm are shown as lines 904A and 904B. The lines 904A and 904B are closer to the ideal case of 902, particularly at frequencies between 100 and 1000 Hertz, which are common frequencies for typical background noises. Thus, the GrTLS-based systems described above may offer the highest improvement in noise reduction over conventional systems, at least for certain noisy signals. Moreover, the noise correlation is improved when the pre-whitening approach is used.

Figure 1:
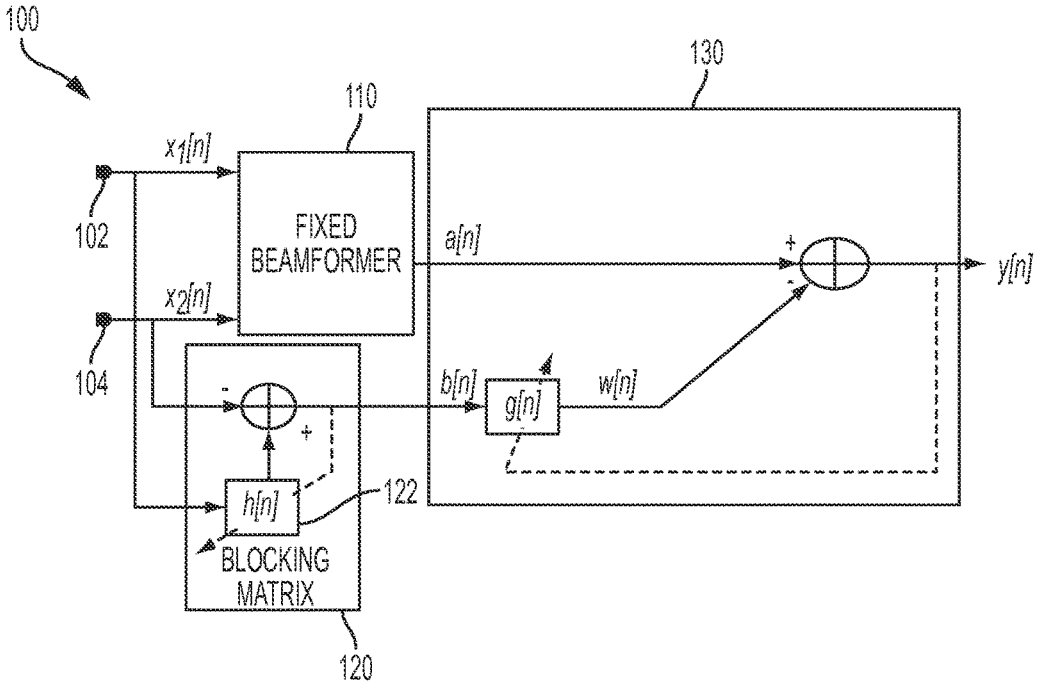
FIG. 1 PRIOR ART
FIG. 1 is an example of an adaptive beamformer according to the prior art.

The adaptive blocking matrix and other components and methods described above may be implemented in a mobile device to process signals received from near and/or far microphones of the mobile device. The mobile device may be, for example, a mobile phone, a tablet computer, a laptop computer, or a wireless earpiece. A processor of the mobile device, such as the device's application processor, may implement an adaptive beamformer, an adaptive blocking matrix, an adaptive noise canceller, such as those described above with reference to FIG. 2, FIG. 4, FIG. 5, FIG. 6, FIG. 7, and/or FIG. 8, or other circuitry for processing. Alternatively, the mobile device may include specific hardware for performing these functions, such as a digital signal processor (DSP). Further, the processor or DSP may implement the system of FIG. 1 with a modified adaptive blocking matrix as described in the embodiments and description above.

The schematic flow chart diagram of FIG. 3 is generally set forth as a logical flow chart diagram. As such, the depicted order and labeled steps are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. For example, although the description above refers to processing and extracting a speech signal from microphones of a mobile device, the above-described methods and systems may be used for extracting other signals from other devices. Other systems that may implement the disclosed methods and systems include, for example, processing circuitry for audio equipment, which may need to extract an instrument sound from a noisy microphone signal. Yet another system may include a radar, sonar, or imaging system that may need to extract a desired signal from a noisy sensor. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method, comprising:

receiving, by a processor coupled to a plurality of sensors, at least a first noisy input signal and a second noisy input signal, each of the first noisy signal and the second noisy signal from the plurality of sensors;

determining, by the processor, at least one estimated noise correlation statistic between the first input signal and the second input signal; and executing, by the processor, a learning algorithm in an adaptive blocking matrix that estimates an inter-sensor signal model between the first noisy input signal and the second noisy input signal based, at least in part, on the at least one estimated noise correlation statistic such that a noise correlation is maintained between an input to an adaptive noise canceller module and an output of the blocking matrix.

2. The method of claim 1, wherein the step of executing the learning algorithm comprises executing an adaptive filter that calculates at least one filter coefficient based, at least in part, on the estimated noise correlation statistic.

3. The method of claim 2, wherein the step of executing the adaptive filter comprises solving a total least squares (TLS) cost function comprising the estimated noise correlation statistic.

4. The method of claim 2, wherein the step of executing the adaptive filter comprises executing a gradient descent total least squares (GrTLS) learning method that includes the estimated noise correlation statistic to minimize the total least squares (TLS) cost function.

5. The method of claim 2, wherein the step of executing the adaptive filter comprises executing a least squares (LS) learning method that includes the estimated noise correlation statistic to minimize the least squares (LS) cost function.

6. The method of claim 2, wherein the step of executing the adaptive filter comprises solving a least squares (LS) cost function to derive a least mean squares (LMS) learning method that uses the estimated noise correlation statistic.

7. The method of claim 1, further comprising filtering, by the processor, at least one of the first noisy input signal and the second noisy input signal before the step of determining the at least one estimated noise correlation statistic.

8. The method of claim 5, wherein the step of filtering comprises applying a spatial pre-whitening approximation to at least one of the first noisy signal and the second noisy signal.

9. The method of claim 8, wherein the step of applying the spatial pre-whitening approximation is performed without a direct matrix inversion and without a matrix square root computation.

10. The method of claim 8, further comprising steps of:

applying the estimated inter-sensor signal model to at least one of the first noisy input signal and the second noisy input signal;

combining the first noisy input signal and the second noisy input signal after applying the estimated inter-sensor signal model to at least one of the first noisy input signal and the second noisy input signal; and applying an inverse pre-whitening filter on the combined first noisy input signal and the second noisy input signal.

11. An apparatus, comprising:

a first input node configured to receive a first noisy input signal;

a second input node configured to receive a second noisy input signal;

a processor coupled to the first input node and coupled to the second input node and configured to perform steps comprising:

receiving at least the first noisy input signal and the second noisy input signal;

determining at least one estimated noise correlation statistic between the first noisy input signal and the second noisy input signal; and executing a learning algorithm that estimates an inter-sensor signal model between the first noisy input signal and the second noisy input signal based, at least in part, on the at least one estimated noise correlation statistic such that a noise correlation is maintained between an input to an adaptive noise canceller module and an output of the blocking matrix.

12. The apparatus of claim 11, wherein the step of executing the learning algorithm comprises executing an adaptive filter that calculates at least one filter coefficient based, at least in part, on the estimated noise correlation statistic.

13. The apparatus of claim 12, wherein the step of executing the adaptive filter comprises solving a total least squares (TLS) cost function comprising the estimated noise correlation statistic.

14. The apparatus of claim 12, wherein the step of executing the adaptive filter comprises executing a gradient descent total least squares (GrTLS) learning method that includes the estimated noise correlation statistic to minimize the total least squares (TLS) cost function.

15. The apparatus of claim 12, wherein the step of executing the adaptive filter comprises executing a least squares (LS) learning method that includes the estimated noise correlation statistic to minimize the least squares (LS) cost function.

16. The apparatus of claim 12, wherein the step of executing the adaptive filter comprises solving a least squares (LS) cost function to derive a least mean squares (LMS) learning method that uses the estimated noise correlation statistic.

17. The apparatus of claim 11, wherein the processor is further configured to execute a step of filtering, by the processor, at least one of the first noisy input signal and the second noisy input signal before the step of determining the at least one estimated noise correlation statistic.

18. The apparatus of claim 17, wherein the step of filtering comprises applying a spatial pre-whitening approximation to at least one of the first noisy signal and the second noisy signal.

19. The apparatus of claim 18, wherein the step of applying the spatial pre-whitening approximation is performed without a direct matrix inversion and without a matrix square root computation.

20. The apparatus of claim 18, wherein the processor is further configured to execute steps comprising:

applying the estimated inter-sensor signal model to at least one of the first noisy input signal and the second noisy input signal;

combining the first noisy input signal and the second noisy input signal after applying the estimated inter-sensor signal model to at least one of the first noisy input signal and the second noisy input signal; and applying an inverse pre-whitening filter on the combined first noisy input signal and the second noisy input signal.

21. The apparatus of claim 11, wherein the first input node is configured to couple to a near microphone, and wherein the second input node is configured to couple to a far microphone.

22. The apparatus of claim 11, wherein the processor is a digital signal processor (DSP).

23. An apparatus, comprising:

a first input node configured to receive a first noisy input signal from a first sensor;

a second input node configured to receive a second noisy input signal from a second sensor;

a fixed beamformer module coupled to the first input node and coupled to the second input node;

an adaptive blocking matrix module coupled to the first input node and coupled to the second input node, wherein the adaptive blocking matrix module executes a learning algorithm that estimates an inter-sensor signal model between the first noisy input signal and the second noisy input signal based, at least in part, on at least one estimated noise correlation statistic; and an adaptive noise canceller coupled to the fixed beamformer module and coupled to the adaptive blocking matrix module, wherein the adaptive noise canceller is configured to output an output signal representative of an audio signal received at the first sensor and the second sensor, wherein the adaptive blocking matrix is configured to maintain a noise correlation between an input to the adaptive noise canceller and an output of the adaptive blocking matrix.

24. The apparatus of claim 23, wherein the blocking matrix module is configured to execute steps comprising:

applying a spatial pre-whitening approximation to the first noisy signal;

applying the spatial pre-whitening approximation to the second noisy signal;

applying the estimated inter-sensor signal model to at least one of the first input noisy signal and the second noisy input signal;

combining the first noisy input signal and the second noisy input signal after applying the estimated inter-sensor signal model; and applying an inverse pre-whitening filter on the combined first noisy input signal and the second noisy input signal.

25. A method, comprising:

receiving, by a processor coupled to a plurality of sensors, at least a first noisy input signal and a second noisy input signal from the plurality of sensors; and executing, by the processor, a gradient descent based total least squares (GrTLS) algorithm that estimates an inter-sensor signal model between the first noisy input signal and the second noisy input signal.

26. The method of claim 25, further comprising applying a pre-whitening filter to at least one of the first noisy input signal and the second noisy input signal.

27. The method of claim 26, wherein the step of applying a pre-whitening filter comprises applying a spatial and a temporal pre-whitening filter.

28. The method of claim 25, wherein the step of executing the GrTLS algorithm includes at least one estimated noise correlation statistic such that a noise correlation is maintained between an input to an adaptive noise canceller and an output of an adaptive blocking matrix.

29. An apparatus, comprising:

a first input node for receiving a first noisy input signal;

a second input node for receiving a second noisy input signal; and a processor coupled to the first input node, coupled to the second input node, and configured to perform the step of executing a gradient descent based total least squares (GrTLS) algorithm that estimates an inter-sensor signal model between the first noisy input signal and the second noisy input signal.

30. The apparatus of claim 29, wherein the processor is further configured to perform a step comprising applying a pre-whitening filter to at least one of the first noisy input signal and the second noisy input signal.

31. The apparatus of claim 29, wherein the step of applying a pre-whitening filter comprises applying a spatial and a temporal pre-whitening filter.

32. The apparatus of claim 29, wherein the step of executing the GrTLS algorithm includes at least one estimated noise correlation statistic such that a noise correlation is maintained between an input to an adaptive noise canceller and an output of an adaptive blocking matrix.

* * * * *